US005759484A

United States Patent [19]

Kashii et al.

[11] Patent Number: 5,759,484

[45] Date of Patent: Jun. 2, 1998

[54] HIGH STRENGTH AND HIGH DUCTILITY TITANIUM ALLOY

[75] Inventors: Hideaki Kashii, Zushi; Akira Nakamura, Kawasaki; Naoya Kitazaki, Tokyo; Yoshihisa Kitagawa; Kenji Koide, both of Kobe, all of Japan

[73] Assignees: Director General of the Technical Research and Developent Institute, Japan Defense Agency, Tokyo; Kabushiki Kaisha Kobe Seiko Sho, Kobe, both of Japan

[21] Appl. No.: 564,622

[22] Filed: Nov. 29, 1995

[30] Foreign Application Priority Data

Nov. 29, 1994 [JP] Japan ..... 6-295127
Nov. 29, 1994 [JP] Japan ..... 6-295128

[51] Int. Cl.[6] ..... C22C 14/00

[52] U.S. Cl. ..... 420/420; 148/421

[58] Field of Search ..... 148/421; 420/420

[56] References Cited

U.S. PATENT DOCUMENTS

| | | | |
|---|---|---|---|
| 4,134,758 | 1/1979 | Nagai et al. | 148/421 |
| 4,898,624 | 2/1990 | Chakrabarti et al. | 148/421 |
| 4,943,412 | 7/1990 | Bania et al. | 420/420 |

FOREIGN PATENT DOCUMENTS

| | | | |
|---|---|---|---|
| 652000 | 11/1962 | Canada | 420/420 |
| 2747588 | 11/1978 | Germany | 420/420 |
| 60-258457 | 12/1985 | Japan | 420/420 |
| 5-59510 | 3/1993 | Japan . | |
| 5-72452 | 10/1993 | Japan . | |
| 6-108187 | 4/1994 | Japan . | |
| 781535 | 8/1957 | United Kingdom | 420/420 |

OTHER PUBLICATIONS

Transactions AIME, Journal of Metals, vol. 188, Feb. 1950, pp. 277–286, Walter L. Finlay, et al., "Effects of Three Interstitial Solutes (Nitrogen, Oxygen, and Carbon) on the Mechanical Properties of High–Purity, Alpha Titanium".

Transactions AIME, Journal of Metals, vol. 188, Oct. 1950, pp. 1261–1266, R. I. Jaffee, et al., "Alloys of Titanium with Carbon, Oxygen, and Nitrogen".

*Primary Examiner*—John Sheehan
*Attorney, Agent, or Firm*—Oblon, Spivak, McClelland, Maier & Neustadt, P.C.

[57] ABSTRACT

Disclosed is a Ti alloy which can provide a high strength and achieve a high ductility only with an annealing treatment without being provided a solution treating and aging process by adding O, C and Fe in a good balance to a basic chemical composition system such as Al and V in a Ti-6Al-4V alloy or a chemical composition system obtained by increasing Al in the above chemical component system and further adding thereto a suitable amount of N according to the addition amounts of Al, O, C, and Fe.

11 Claims, 4 Drawing Sheets

HIGH STRENGTH AND HIGH DUCTILITY TITANIUM ALLOY

BACKGROUND OF THE INVENTION

1. Field of the Invention

The present invention relates to a titanium (Ti) alloy applied to various applications such as air crafts, chemical engineering machineries and deep sea research vessels, more specifically to a Ti alloy which achieves a high strength and a high ductility by improving a Ti-6Al-4V alloy by adding nitrogen or carbon, or nitrogen or carbon together with aluminum.

2. Description of the Prior Art

In recent years, a lighter mass of air crafts and the like is desired, and this is accompanied with an increasing requirement for a high strength and a high ductility α+β type Ti alloy, specifically a Ti-6Al-4V alloy. In the Ti-6Al-4V alloy, however, a tensile strength obtained by an annealing treatment is limited to 1.1 GPa at most. On the other hand, in order to achieve a high strength of a Ti alloy, a solution treating at a high temperature in the α+β field and aging, or the solution treating and over-aging is usually carried out. However, the above treatment has a drawback that warping is caused on Ti alloy plate after the treatment and a correction processing is required.

From a viewpoint of reducing the generation of the warping described above, such a technique as disclosed in Japanese Patent Laid-Open No. HEI 5-59510 is proposed. In this technique, an α+β type Ti alloy having prescribed chemical compositions is heated to a temperature within a range of (a β transus-150° C.) to less than the β transus and then cooled down at a cooling speed ranging from 0.5° to 10° C./sec as a solution treatment, followed by further subjecting the material treated above to an aging treatment at temperatures ranging from 400° to 600° C. However, while the generation of warping is reduced, this technique involves the problem that two steps of a solution treatment and an aging treatment are required, and the process is therefore complicated.

A Ti alloy having a tensile strength exceeding 1.1 GPa includes a near β series Ti alloy as a kind of α+β type Ti alloys and a β type Ti alloy, and surveys made by the present inventors revealed that the ductility was inferior under a high speed deformation. Investigations made by the present inventors on ductility under high speed deformation showed that the alloys described above were excellent in the ductility under a high speed deformation at an Mo equivalent (Mo equivalent=Mo+0.67 V+2.9 Fe+1.6 Cr+0.28 Nb+0.22 Ta) of 4.0 or less in a Ti alloy.

On the other hand, "a nitrogen-containing high strength Ti alloy" containing a relatively much amount of N (0.06 to 0.20%) and Mo of 1% or more as an essential component is disclosed in Japanese Patent Laid-Open No. HEI 6-108187 from the viewpoint of developing a high strength and high ductility Ti alloy. However, this alloy involves a defect that the Mo equivalent is increased to 4.0 or more by adding Mo and therefore the alloy has an inferior ductility under a high speed deformation.

OBJECT OF THE INVENTION

The present invention has been made under such technical background, and an object thereof is to provide a Ti alloy which can provide a high strength only with an annealing treatment without providing a solution treating and aging and which can achieve a high ductility.

SUMMARY OF THE INVENTION

A Ti alloy of the present invention which has been able to achieve the object described above has an essential point in that the above Ti alloy comprises Al of 5.5 to 6.75%, V of 3.5 to 4.5%, Fe of 0.25 to 0.35%, O of 0.15 to 0.25%, C of 0.10% or less, and N of more than 0.05 to 0.15% each in terms of mass %, with the balance comprising Ti and inevitable impurities.

The object of the present invention can be achieved as well by a Ti alloy comprising Al of 5.5 to 6.75%, V of 3.5 to 4.5%, Fe of 0.25 to 0.35%, O of 0.15 to 0.25%, C of more than 0.10% to 0.30%, and N of 0.05% or less each in terms of mass %, with the balance comprising Ti and inevitable impurities.

Further, in the respective alloys described above, the preferred content of Al falls in a range of 6.0 to 6.75 mass %, and a high strength effect by Al is maximized in this range.

The object described above can be achieved as well by a Ti alloy in which the content of Al has been increased. Such the Ti alloy has an essential point in that the above Ti alloy comprises Al of more than 6.75 to 8.00%, V of 3.5 to 4.5%, Fe of 0.25 to 0.35%, O of 0.15 to 0.25%, C of 0.10% or less, and N of 0.15% or less each in terms of mass %, with the balance comprising Ti and inevitable impurities.

In this alloy, the preferred content of N falls in a range of 0.03 to 0.15 mass %, and an action by N is maximized in this range.

Further, the object of the present invention can be achieved as well by a Ti alloy comprising Al of more than 6.75 to 8.00%, V of 3.5 to 4.5%, Fe of 0.25 to 0.35%, O of 0.15 to 0.25%, C of more than 0.10% to 0.20%, and N of 0.03% or less each in terms of mass %, with the balance comprising Ti and inevitable impurities.

DETAILED DESCRIPTION OF THE INVENTION

Elements such as O, C, N, and Fe contained in the Ti-6Al-4V alloy described above are standardized (AMS 4298L) in the upper limits thereof as impurities in the United States and controlled to O: 0.20 mass % or less, C: 0.10 mass % or less, N: 0.05 mass % or less, and Fe: 0.30 mass % or less. However, investigations made by the present inventors have revealed that the incorporation thereof as standardized above does not necessarily provide desired characteristics. Accordingly, from the viewpoint of improving the characteristics of the Ti-6Al-4V series alloy described above to achieve the high strength and high ductility, the present inventors have further repeated investigations on the optimum contents of the elements such as Al, O, C, N, and Fe.

It has so far been said that the addition of Al to a Ti alloy deteriorates markedly the ductility while increasing the strength. For example, it is reported in Japanese Patent Publication No. HEI 5-72452 that the addition of N to pure Ti deteriorates the ductility while increasing the strength.

Figure 1:
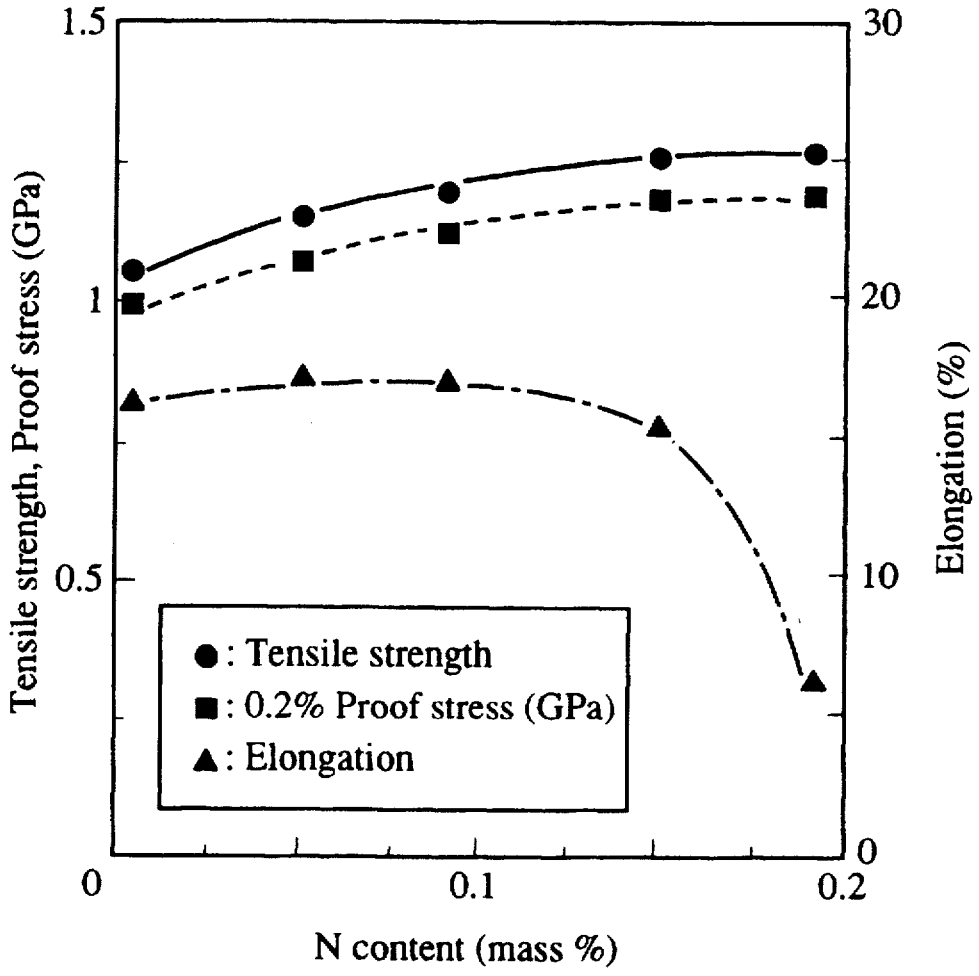
FIG. 1 is a graph showing a relation of tensile properties with an N content in a Ti alloy prepared by adding O, C and Fe to a Ti-6Al-4V alloy in a good balance.
Figure 2:
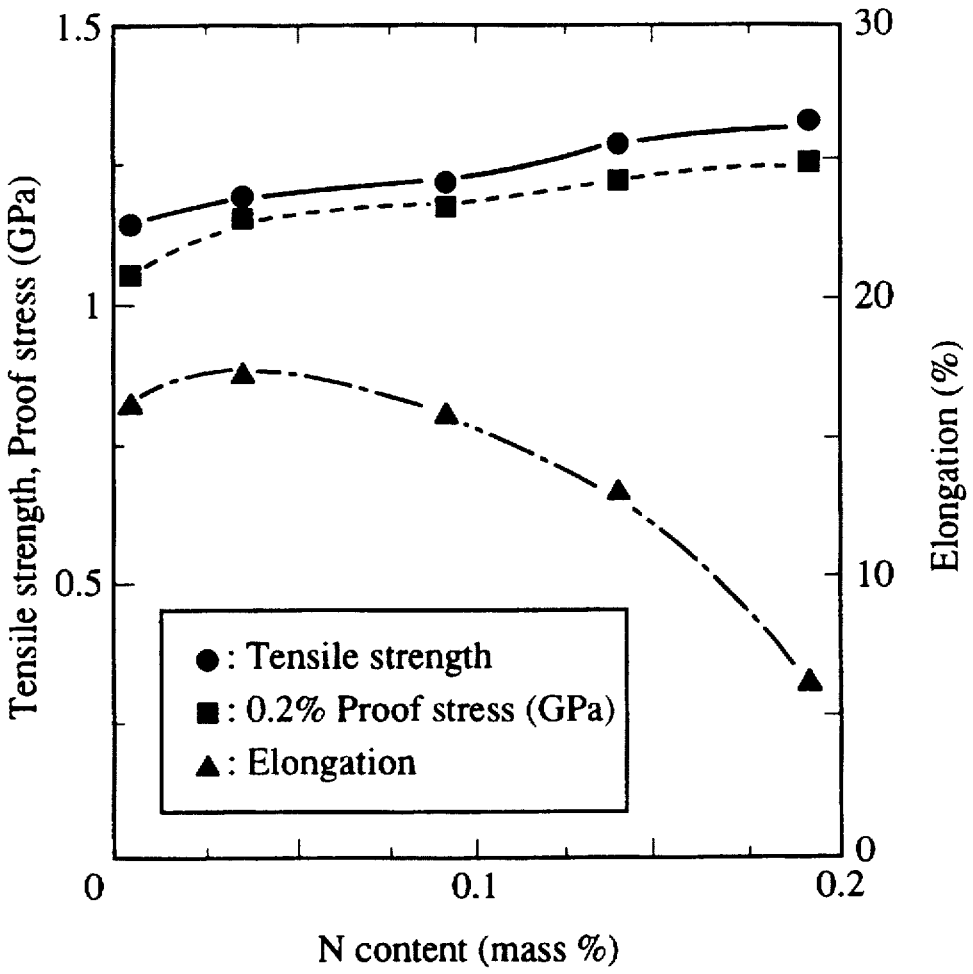
FIG. 2 is a graph showing a relation of tensile properties with an N content in a Ti alloy prepared by adding Al, O, C and Fe to a Ti-6Al-4V alloy in a good balance.

However, detailed investigations made by the present inventors have resulted in finding that the addition of O, C and Fe to the Ti-6Al-4V series alloy in a good balance as prescribed in the present invention achieves a high strength and a high ductility by adding N of more than 0.05 to 0.15 mass % as shown in FIG. 1, and therefore coming to complete the present invention. Further, the present inventors have found as well that the addition of Al, O, C and Fe to the Ti-6Al-4V series alloy in a good balance as prescribed in the present invention achieves a high strength and a high ductility by adding N of 0.15 mass % or less (preferably 0.03 to 0.15 mass %) as shown in FIG. 2.

Figure 3:
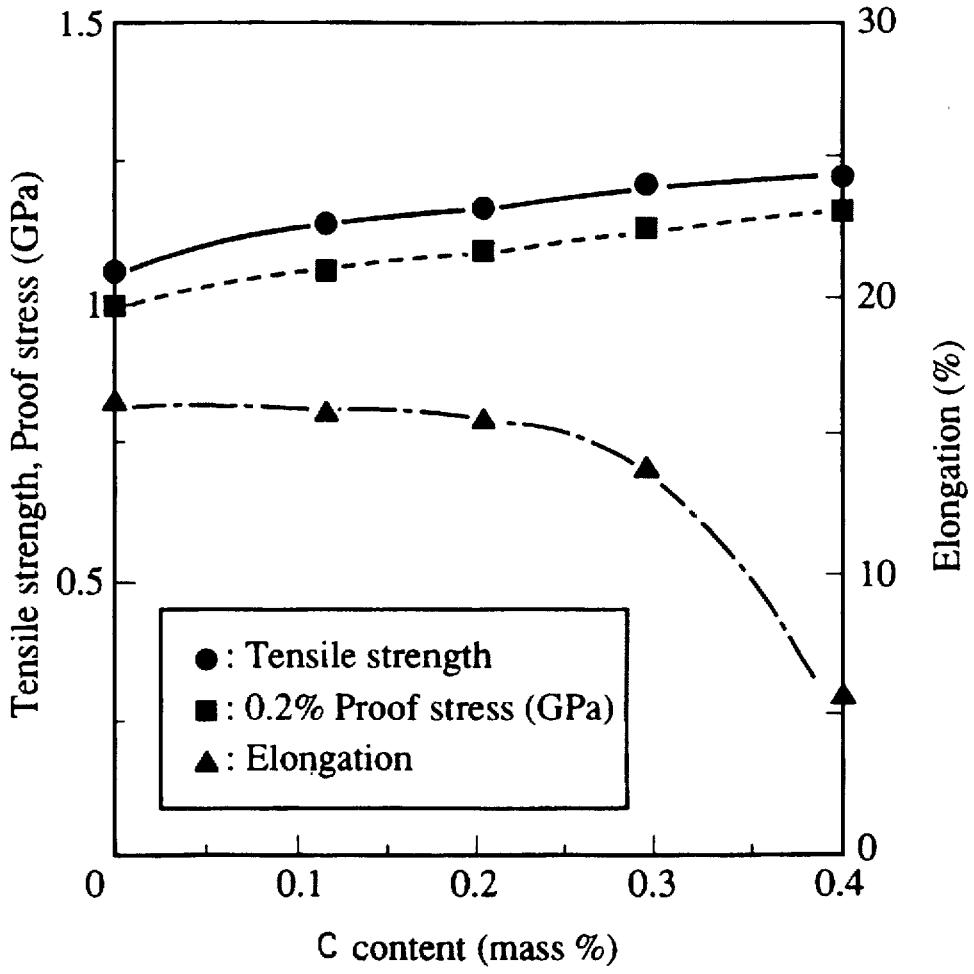
FIG. 3 is a graph showing a relation of tensile properties with a C content in a Ti alloy prepared by adding O, C and Fe to a Ti-6Al-4V alloy in a good balance.
Figure 4:
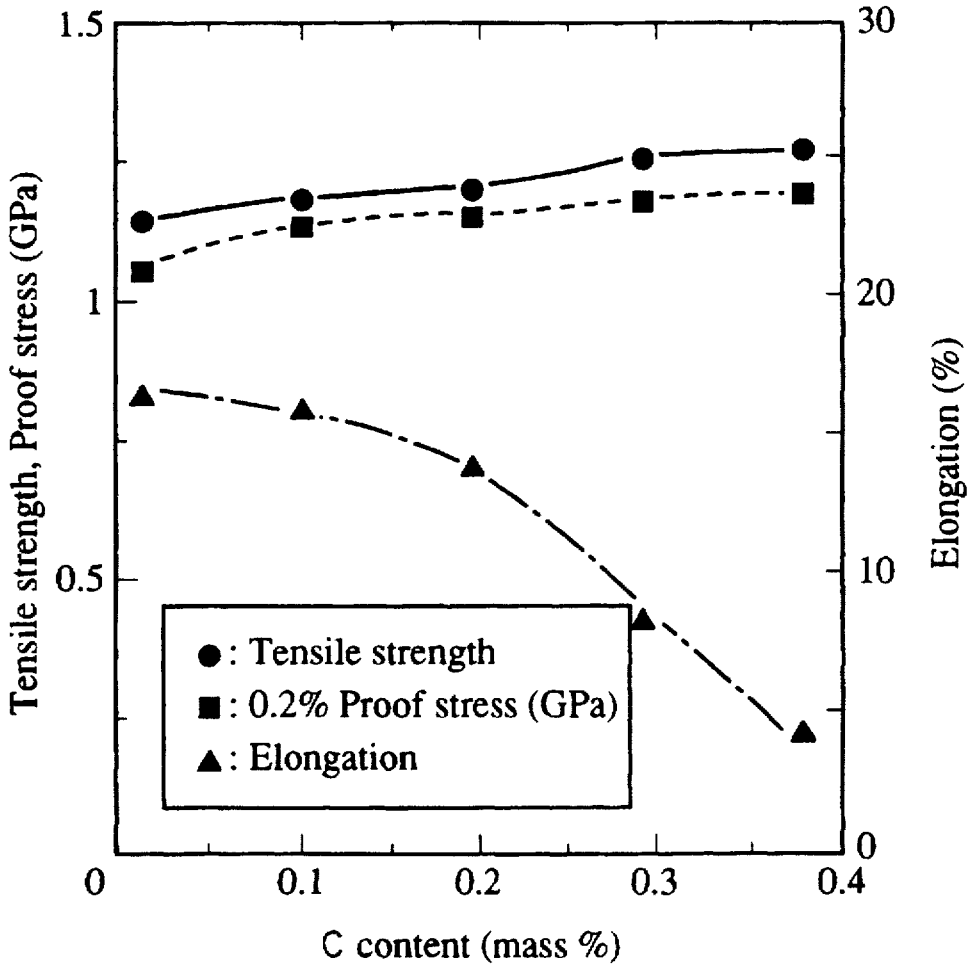
FIG. 4 is a graph showing a relation of tensile properties with a C content in a Ti alloy prepared by adding Al, O, C and Fe to a Ti-6Al-4V alloy in a good balance.

On the other hand, the present inventors have found also on C that the addition of O, N and Fe to the Ti-6Al-4V series alloy in a good balance achieves a high strength and a high ductility by adding C of more than 0.10 to 0.30 mass % as shown in FIG. 3. Further, the present inventors have found as well that the addition of Al, O, N and Fe to the Ti-6Al-4V series alloy in a good balance achieves a high strength and a high ductility by adding C of more than 0.10 to 0.20 mass % as shown in FIG. 4.

Of the preceding Ti alloys of the present invention, the Ti alloy to which Al of more than 6.75 to 8.00 mass % is added is an alloy to which Al being an α-stabilized element is added in a large quantity and O and N or C are added and to which Fe being a β-stabilized element is further added in a good balance. Reasons for restricting the chemical compositions in the Ti alloys of the present invention are as follows.

Al: 5.5 to 6.75 mass % or more than 6.75 to 8.00 mass %

Al is a solution type α-stabilized element. The addition of Al to Ti raises a β transus, and the addition of Al of 6 mass % increases it by about 100° C. Thus, Al stabilizes an α phase which is a low temperature phase in a Ti alloy and is present in a form of a solid solution mainly in the α phase to strengthen the α phase. Al is an alloy element effective for increasing a strength of a Ti alloy. In order to cause such the effects to be displayed, the content of Al has to be 5.5 mass % or more. The content of less than 5.5 mass % can not provide an aimed strength even with the maximum addition of other elements contributing to the improvement in the strength.

However, the content of Al exceeding 6.75 mass % not only saturates the effects thereof but also generates a regular phase of an $\alpha_2$ phase (a $Ti_3Al$ phase) in heat treatment, which causes embrittlement. The content of Al is 6.0 to 6.75 mass %, and a strength-improving effect by Al is maximized in this range.

As described above, it has been said that usually, so much addition of Al generates a regular phase of an $\alpha_2$ phase (a $Ti_3Al$ phase) depending on heat treatment conditions, which causes embrittlement. However, investigations made by the present inventors have shown that the addition of not only Fe as well as V as β-stabilized elements in prescribed amounts but also O and N in a suitable range has achieved the improvement in the strength while securing the ductility even in a Ti alloy to which Al of more than 6.75 mass % is added. If the content of Al exceeds 8.00 mass %, it deteriorates notably the ductility and the toughness and can not provide aimed material characteristics, and therefore the content thereof has to be controlled to 8.00 mass % or less.

V: 3.5 to 4.5 mass %

V is a whole rate solid solution type β-stabilized element. The addition of V lowers a β transus, and the addition of about 4 mass % converts a β phase to a stable α+β type alloy at room temperatures. Thus, V has an effect to stabilize a phase in a high temperature phase and improve a hot processing property by allowing the β phase which is readily subjected to plastic processing to exist. Such the effects are displayed when the content thereof exceeds 3.5 mass %, but the content exceeding 4.5 mass % rather deteriorates the ductility.

Fe: 0.25 to 0.35 mass %

Fe is a β eutectoid type β-stabilized element and has an effect to lower a β transus as is the case with V to expand a phase region. The addition of a trace amount thereof can improve the strength. Fe of 0.25 mass % or more has to be added in order to allow such the effect to be displayed, but the content exceeding 0.35 mass % deteriorates markedly the ductility.

O: 0.15 to 0.25 mass %

The controlled content of O can provide the prescribed strength level. O is an interstitial α-stabilized element and raises a β transus. It reveals an effect to contribute to the improvement in the strength by the addition of a trace amount. O of 0.15 mass % or more has to be added in order to allow such the effect to be displayed, but the content exceeding 0.25 mass % deteriorates the ductility.

The reasons for restricting the basic chemical components such as Al, V, Fe, and O in the Ti alloys of the present invention are as described above. With respect to C and N, it is required to control suitably the addition amounts thereof depending on the content of Al to maintain a good balance between them. Accordingly, the reasons for restricting the chemical compositions of C and N will be explained on a case by case basis depending on a difference in the content of Al.

(1) Case where the content of Al is 5.5 to 6.75 mass %

C: 0.10 mass % or less or more than 0.10 to 0.30 mass %

C is an interstitial solid solution type element and can contribute to the improvement in strength by the addition of a trace amount thereof. However, when the content of N is more than 0.05 to 0.15 mass %, the excess content of C deteriorates notably the ductility, and therefore the content of C has to be controlled to 0.10 mass % or less. When the content of N is restricted to 0.05 mass % or less, the content of C controlled to more than 0.10 to 0.30 mass % can rather provide the high strength and the high ductility, and in such case, the content of C exceeding 0.30 mass % results in deteriorating the ductility.

N: more than 0.05 to 0.15 mass % or 0.05 mass % or less

N is an interstitial solid solution type α-stabilized element. The addition of a trace amount thereof raises the transus and can contribute to the improvement in the strength. When the content of C is 0.10 mass % or less, N of 0.05 mass % or more has to be added in order to cause such the effects to be displayed, but the content of N exceeding 0.15 mass % deteriorates the ductility. When the content of C is controlled to more than 0.10 to 0.30 mass %, the content of N is required to be restricted to 0.05 mass % or less as described above, and this can provide the high strength and the high ductility.

That is, the Ti alloys of the present invention containing such the chemical components contain more C or N than the AMS standard value, and this allows an optimum balance with Fe and O to be maintained, which has resulted in achieving the high strength and the high ductility as desired.

(2) Case where the content of Al is more than 6.75 to 8.00 mass %

C: 0.10 mass % or less or more than 0.10 to 0.20 mass %

As described above, C is an interstitial solid solution type element and can contribute to the improvement in strength by the addition of a trace amount thereof. However, in the case where the content of Al is increased, the excess addition of C deteriorates markedly the ductility when the content of N is 0.15 mass % or less (particularly, 0.03 to 0.15 mass %), and therefore the content of C has to be controlled to 0.10 mass % or less. When the content of N is restricted to 0.03 mass % or less, the content of C controlled to more than 0.10 to 0.20 mass % can rather provide the high strength and the high ductility, and in this case, the content of C exceeding 0.20 mass % results in deteriorating the ductility.

N: 0.15 mass % or less

As described above, N is an interstitial solid solution type α-stabilized element. The addition of a trace amount thereof raises a β transus and can contribute to the improvement in strength. However, the content of N exceeding 0.15 mass % lowers the ductility. From the viewpoint of allowing the preceding effects by N to be effectively displayed, when the content of C is 0.10 mass % or less, N of 0.03 mass % or more is preferably added, and more preferably N of 0.06 mass % or more is added. When the content of C is controlled to more than 0.10 to 0.20 mass %, the content of N has to be restricted to 0.03 mass % or less as described above, and this can provide the high strength and the high ductility.

It is reported that in pure Ti, the addition of N has a function to improve the strength as much as or more than O of the same amount (for example, "W. L. Finday and J. A. Synder: Trans. AIME. 188 February (1950), p. 277" and "R. I. Jaffee, H. B. Ogden and D. J. Maykuth: Trans. AIME. 188 October (1950), p. 1261"), and in the present invention, such function of N is applied to Ti alloys. Further, the Ti alloys described in Japanese Patent Application Laid-Open No. HEI 6-108187 above also is construed as prepared from the viewpoint of allowing the containing effects of N to be displayed by adding more amount of N than the AMS standard value. As described above, this alloy contains Mo as an essential component. In addition, it has an Mo equivalent of 4.0 or more and has a defect that ductility is inferior under a high speed deformation.

EXAMPLES

The present invention will concretely be explained below with reference to Examples in terms of structures, functions and effects. However, the present invention will not naturally be restricted by the following Examples, and it will be possible to carry out the Examples by changing suitably them within a range which is compatible with the scopes described above and later, but all of them will be involved in the technical scope of the present invention.

Example 1

An ingot having a chemical composition shown in the following Table 1 was forged in a β region to break completely the cast structure and then subjected to a sufficient processing at temperatures of 900° C. or higher in an α+β region. After the processing, the forged ingot was annealed at 705° C. and then subjected to a tensile test at room temperatures to measure the respective tensile properties (tensile strength, 0.2% proof stress, elongation, and reduction of area). In this case, the preparation of tensile test pieces and the implementation of the tensile test were carried out according to ASTM E8. The results of the tensile test are shown in the following Table 2.

TABLE 1

| Alloy No. | Chemical composition (mass %) Al | V | Fe | O | C | N | Balance | |
|---|---|---|---|---|---|---|---|---|
| 1 | 6.15 | 4.19 | 0.201 | 0.148 | 0.005 | 0.0058 | Ti | AMS standard product |
| 2 | 6.56 | 4.25 | 0.252 | 0.187 | 0.002 | 0.0040 | Ti | AMS standard product |
| 3 | 6.68 | 4.32 | 0.310 | 0.210 | 0.016 | 0.051 | Ti | Example |
| 4 | 6.64 | 4.29 | 0.323 | 0.213 | 0.012 | 0.092 | Ti | Example |
| 5 | 6.63 | 4.30 | 0.292 | 0.205 | 0.011 | 0.151 | Ti | Example |
| 6 | 6.59 | 4.46 | 0.276 | 0.197 | 0.018 | 0.061 | Ti | Example |
| 7 | 6.33 | 4.15 | 0.261 | 0.224 | 0.009 | 0.080 | Ti | Example |
| 8 | 6.57 | 4.27 | 0.297 | 0.210 | 0.013 | 0.191 | Ti | Comparative Example |
| 9 | 6.62 | 4.30 | 0.296 | 0.327 | 0.017 | 0.140 | Ti | Comparative Example |
| 10 | 6.00 | 4.00 | 0.200 | 0.150 | — | 0.100 | Ti | Comparative Example |
| 11 | 6.12 | 4.14 | 0.274 | 0.133 | 0.010 | 0.094 | Ti | Comparative Example |
| 12 | 5.40 | 4.14 | 0.311 | 0.207 | 0.013 | 0.090 | Ti | Comparative Example |
| 13 | 6.60 | 4.31 | 0.390 | 0.211 | 0.018 | 0.110 | Ti | Comparative Example |
| 14 | 6.62 | 4.31 | 0.303 | 0.207 | 0.115 | 0.007 | Ti | Example |
| 15 | 6.60 | 4.32 | 0.312 | 0.209 | 0.203 | 0.003 | Ti | Example |
| 16 | 6.58 | 4.23 | 0.298 | 0.211 | 0.295 | 0.008 | Ti | Example |
| 17 | 6.59 | 4.25 | 0.307 | 0.210 | 0.307 | 0.007 | Ti | Comparative Example |

TABLE 2

| Alloy No. | Tensile strength (GPa) | 0.2% proof stress (GPa) | Elongation (%) | Reduction of area (%) | |
|---|---|---|---|---|---|
| 1 | 0.947 | 0.879 | 16.0 | 36.6 | AMS standard product |
| 2 | 1.055 | 0.991 | 16.4 | 36.9 | AMS standard product |
| 3 | 1.148 | 1.066 | 17.2 | 40.0 | Example |
| 4 | 1.192 | 1.117 | 17.0 | 41.0 | Example |
| 5 | 1.258 | 1.179 | 15.5 | 31.0 | Example |
| 6 | 1.116 | 1.039 | 16.4 | 39.1 | Example |
| 7 | 1.128 | 1.040 | 14.8 | 32.3 | Example |
| 8 | 1.263 | 1.181 | 8.1 | 20.7 | Comparative Example |
| 9 | 1.257 | 1.215 | 4.6 | 6.8 | Comparative Example |
| 10 | 1.067 | 1.009 | 8.0 | 17.0 | Comparative Example |
| 11 | 1.073 | 1.001 | 16.6 | 32.0 | Comparative Example |
| 12 | 0.817 | 0.764 | 17.3 | 38.6 | Comparative Example |
| 13 | 1.252 | 1.181 | 8.5 | 21.5 | Comparative Example |
| 14 | 1.131 | 1.052 | 15.8 | 35.8 | Example |
| 15 | 1.162 | 1.089 | 15.6 | 37.8 | Example |
| 16 | 1.205 | 1.180 | 13.9 | 32.6 | Example |
| 17 | 1.221 | 1.162 | 5.8 | 18.6 | Comparative Example |

The following considerations can be derived from these results. First, the alloy No. 1 is a Ti-6Al-4V alloy prepared according to the AMS standard, and the tensile strength did not exceed 1.1 GPa only with an annealing treatment. The alloy No. 2 is also a Ti-6Al-4V alloy prepared according to the AMS standard. In this alloy, Al, Fe and O were added up to the amounts close to the standard limit values as compared with the alloy No. 1, but the tensile strength did not exceed 1.1 GPa.

The alloy No. 8 is a Ti alloy (Comparative Example) prepared by increasing the N content over the range prescribed in the present invention, and this alloy was notably deteriorated in the ductility (elongation and reduction of area) while increased in the tensile strength. The alloy No. 9 is a Ti alloy (Comparative Example) prepared by increasing the O content over the range prescribed in the present invention, and this alloy was notably deteriorated in the ductility (elongation and reduction of area) while increased in the tensile strength, as was the case with the alloy No. 8.

The alloy No. 10 is a Ti alloy (Comparative Example) prepared by decreasing the Fe content below the range prescribed in the present invention, and this alloy was markedly deteriorated both in the tensile strength and the ductility. The alloy No. 11 is a Ti alloy (Comparative Example) prepared by decreasing the O content below the range prescribed in the present invention, and this alloy was lower than 1.1 GPa in the tensile strength while not lowered so much in the ductility. The alloy No. 12 is a Ti alloy (Comparative Example) prepared by decreasing the Al content below the range prescribed in the present invention. This alloy was notably deteriorated in the tensile strength and the 0.2% proof stress while not lowered so much in the ductility. The alloy No. 13 is a Ti alloy (Comparative Example) prepared by increasing the Fe content over the range prescribed in the present invention, and this alloy was notably deteriorated in the ductility.

Meanwhile, the alloy No. 3 to 7 are alloys prepared in the Examples in which the requisites prescribed in the present invention are satisfied, and it can be found that every one of them exceeds 1.1 GPa in the tensile strength and is largely over 10% which is the standard value of a Ti-6Al-4V alloy also in the elongation. The alloy No. 14 to 16 are alloys prepared in the Examples in which the N contents are decreased and the C contents are increased as compared with the Examples of the alloy No. 3 to 7, and they were largely over the expected values both in the strength and the elongation. The alloy No. 17 is an alloy prepared in the Comparative Example in which the C content is increased more than the range (0.30 mass %) prescribed in the present invention, and this alloy was notably deteriorated in the ductility while the strength was largely over the expected value.

Example 2

An ingot having a chemical composition shown in the following Table 3 was forged in a β region to break completely the cast structure in the same manner as in Example 1 and then subjected to a sufficient processing at temperatures of 900° C. or higher in an α+β region. After the processing, the forged ingot was annealed at 705° C. and then subjected to a tensile test at room temperatures to measure the respective tensile properties (tensile strength, 0.2% proof stress, elongation, and reduction of area). In this case, the preparation of tensile test pieces and the implementation of the tensile test were carried out the same manners as those in Example 1. The results of the tensile test are shown in the following Table 4.

TABLE 3

| Alloy | Chemical composition (mass %) | | | | | | | |
|---|---|---|---|---|---|---|---|---|
| No. | Al | V | Fe | O | C | N | Balance | |
| 18 | 7.10 | 3.97 | 0.293 | 0.196 | 0.015 | 0.005 | Ti | Example |
| 19 | 7.15 | 3.95 | 0.313 | 0.204 | 0.016 | 0.035 | Ti | Example |
| 20 | 7.09 | 3.97 | 0.301 | 0.208 | 0.014 | 0.091 | Ti | Example |
| 21 | 7.11 | 3.98 | 0.281 | 0.208 | 0.015 | 0.140 | Ti | Example |
| 22 | 7.40 | 3.85 | 0.260 | 0.218 | 0.018 | 0.016 | Ti | Example |
| 23 | 7.04 | 3.94 | 0.301 | 0.200 | 0.015 | 0.190 | Ti | Comparative Example |
| 24 | 7.10 | 3.97 | 0.233 | 0.206 | 0.014 | 0.042 | Ti | Comparative Example |

TABLE 3-continued

| Alloy | Chemical composition (mass %) | | | | | | | |
|---|---|---|---|---|---|---|---|---|
| No. | Al | V | Fe | O | C | N | Balance | |
| 25 | 8.32 | 4.01 | 0.299 | 0.210 | 0.020 | 0.089 | Ti | Comparative Example |
| 26 | 7.13 | 4.00 | 0.300 | 0.205 | 0.102 | 0.004 | Ti | Example |
| 27 | 7.12 | 3.88 | 0.314 | 0.213 | 0.198 | 0.004 | Ti | Example |
| 28 | 7.05 | 3.95 | 0.311 | 0.207 | 0.294 | 0.003 | Ti | Comparative Example |
| 29 | 7.15 | 4.01 | 0.299 | 0.189 | 0.380 | 0.005 | Ti | Comparative Example |

TABLE 4

| Alloy No. | Tensile strength (GPa) | 0.2% proof stress (GPa) | Elongation (%) | Reduction of area (%) | |
|---|---|---|---|---|---|
| 18 | 1.141 | 1.052 | 16.6 | 42.0 | Example |
| 19 | 1.186 | 1.149 | 17.4 | 42.8 | Example |
| 20 | 1.213 | 1.172 | 16.0 | 37.6 | Example |
| 21 | 1.287 | 1.216 | 13.2 | 28.9 | Example |
| 22 | 1.152 | 1.075 | 14.2 | 30.1 | Example |
| 23 | 1.327 | 1.251 | 6.6 | 10.8 | Comparative Example |
| 24 | 1.095 | 1.021 | 18.6 | 42.0 | Comparative Example |
| 25 | 1.228 | 1.187 | 7.7 | 25.6 | Comparative Example: |
| 26 | 1.178 | 1.131 | 16.0 | 39.4 | Example |
| 27 | 1.197 | 1.145 | 13.9 | 32.7 | Example |
| 28 | 1.249 | 1.173 | 8.8 | 21.3 | Comparative Example |
| 29 | 1.263 | 1.182 | 4.2 | 6.5 | Comparative Example |

The following considerations can be derived from these results. First, the alloy No. 23 is a Ti alloy (Comparative Example) prepared by increasing the N content over the range prescribed in the present invention, and this alloy was notably deteriorated in the ductility (elongation and reduction of area) while increased in the tensile strength. The alloy No. 24 is a Ti alloy (Comparative Example) prepared by decreasing the Fe content below the range prescribed in the present invention, and this alloy fell below 1.1 GPa in the tensile strength while having a good ductility (elongation and reduction of area). The alloy No. 25 is a Ti alloy (Comparative Example) prepared by increasing the Al content over the range prescribed in the present invention, and this alloy was lower than 10% which was the standard value of a Ti-6Al-4V alloy in the elongation.

Meanwhile, the alloy No. 18 to 22 are alloys prepared in the Examples in which the requisites prescribed in the present invention are satisfied, and it can be found that every one of them exceeds 1.1 GPa in the tensile strength and is largely more than 10% which is the standard value of a Ti-6Al-4V alloy also in the elongation. The alloy No. 26 and 27 are alloys prepared in the Examples in which the C contents are increased and the N contents are decreased as compared with the Examples of the alloy No. 18 to 22, and it can be found that all of them exceed 1.1 GPa in the tensile strength and are largely more than 10% which is the standard value of the Ti-6Al-4V alloy also in the elongation.

The alloy No. 28 and 29 are alloys prepared in the Comparative Examples in which the C content is increased more than the range (0.20 mass %) prescribed in the present invention, and this alloy was largely lower than 10% in the elongation while exceeding 1.1 GPa in the tensile strength.

EFFECT OF THE INVENTION

The present invention is constituted as described above and has successfully obtained a Ti alloy capable of having a high strength without being provided a solution treating and aging process and of achieving a high ductility. Since this Ti alloy is not required a correction processing for warping of the material caused by annealing, a lot of a processing width is not needed, which provides an effect of improving the yield. Such Ti alloy is expected to expand further the applicable range of Ti alloys.

What is claimed is:

1. A high strength and high ductility Ti alloy comprising Al of 5.5 to 6.75%, V of 3.5 to 4.5%, Fe of 0.25 to 0.35%, O of 0.15 to 0.25%, C of more than 0.10% to 0.30%, and N of 0.05% or less each in terms of weight %, with the balance comprising Ti and inevitable impurities.

2. A high strength and high ductility Ti alloy as described in claim 1, wherein the content of Al is 6.0 to 6.75 weight %.

3. The high strength and high ductility Ti alloy of claim 1, consisting of:

Al of 5.5 to 6.75%, V of 3.5 to 4.5%, Fe of 0.25 to 0.35%, O of 0.15 to 0.25%, C of more than 0.10% to 0.30%, and N of 0.05% or less, each in terms of weight %, with the balance consisting of Ti and impurities.

4. A high strength and high ductility Ti alloy comprising Al of 7.0% to 8.00%, V of 3.5 to 4.5%, Fe of 0.25 to 0.35%, O of 0.15 to 0.25%, C of more than 0.10% to 0.20%, and N of 0.03% or less each in terms of weight %, with the balance comprising Ti and inevitable impurities.

5. The high strength and high ductility Ti alloy of claim 4, consisting of:

Al of 7.0% to 8.00%, V of 3.5 to 4.5%, Fe of 0.25 to 0.35%, O of 0.15 to 0.25%, C of more than 0.10% to 0.20%, and N of 0.03% or less, each in terms of weight %, with the balance consisting of Ti and impurities.

6. A high strength and high ductility Ti alloy, comprising Al of 7.0 to 8.00%, V of 3.5 to 4.5%, Fe of 0.25 to 0.35%, O of 0.15 to 0.25%, C of 0.10% or less, and N of 0.15% or less each in terms of weight %, with the balance Ti and inevitable impurities.

7. A high strength and high ductility Ti alloy as described in claim 6, wherein the content of N is 0.03 to 0.15 mass %.

8. A high strength and high ductility Ti alloy of claim 7, wherein the content of N is 0.06 to 0.15 weight %.

9. The high strength and high ductility Ti alloy of claim 6, consisting of:

Al of 7.0 to 8.00%, V of 3.5 to 4.5%, Fe of 0.25 to 0.35%, O of 0.15 to 0.25%, C of 0.10% or less, and N of 0.15% of less, each in terms of weight %, with the balance consisting of Ti and impurities.

10. The high strength and high ductility Ti alloy of claim 6, wherein the content of Al is 7.09 to 8.00 weight %.

11. The high strength and high ductility Ti alloy of claim 6, wherein the content of Al is 7.09 to 7.40 weight %, and the content of N is 0.005 to 0.14 weight %.

* * * * *